US007303172B2

(12) United States Patent
Rich

(10) Patent No.: US 7,303,172 B2
(45) Date of Patent: Dec. 4, 2007

(54) SECURE DISH HOLDER

(76) Inventor: Jason H. Rich, 374 Stonebridge Cir., Savannah, GA (US) 31419

( * ) Notice: Subject to any disclaimer, the term of this patent is extended or adjusted under 35 U.S.C. 154(b) by 70 days.

(21) Appl. No.: 11/176,117

(22) Filed: Jul. 6, 2005

(65) Prior Publication Data

US 2006/0006181 A1 Jan. 12, 2006

Related U.S. Application Data

(60) Provisional application No. 60/586,863, filed on Jul. 9, 2004.

(51) Int. Cl.
*A47B 96/06* (2006.01)

(52) U.S. Cl. ..... 248/231.41; 248/230.3; 248/229.12; 248/229.22; 24/455

(58) Field of Classification Search ..... 248/231.41, 248/230.3, 229.12, 229.22, 228.3, 226.11, 248/227.2, 231.61, 316.1, 316.2, 316.4; 24/455
See application file for complete search history.

(56) References Cited

U.S. PATENT DOCUMENTS 550,443 A * 11/1895 Deal ..... 108/146
2,850,079 A * 9/1958 Prushnok et al. ..... 248/506
4,908,066 A * 3/1990 Taylor et al. ..... 108/26
4,948,076 A * 8/1990 Sumrell et al. ..... 248/125.1
5,641,140 A * 6/1997 Sorenson ..... 248/205.3
5,842,671 A * 12/1998 Gibbs ..... 248/231.41
5,996,957 A * 12/1999 Kurtz ..... 248/311.2
6,216,605 B1 * 4/2001 Chapman ..... 108/26
6,217,428 B1 * 4/2001 Paisar ..... 451/365

(Continued)

*Primary Examiner*—Carl D. Friedman
*Assistant Examiner*—Todd M. Epps
(74) *Attorney, Agent, or Firm*—William W. Cochran; Cochran Freund & Young LLC

(57) ABSTRACT

A secure dish holder that easily and firmly attaches to tables and various other structures without relying on suction or adhesive. The secure dish holder is easily released by an adult, but securely holds a dish or another article so that it is not easily spilled or dislodged by a child, by wind, or by movement of the structure. The secure dish holder includes a top plate with a fastener for a dish on the topside. The top plate has slip-resistant padding on the underside that grips the surface to which the secure dish holder attaches. The secure dish holder includes a top plate with posts extending substantially perpendicularly from the underside of the top plate and a bottom plate with holes that slide snugly over the posts so the bottom plate slides along the posts. A compressible material is fixed to the topside of the bottom plate. When the end of the bottom plate nearest the holes is squeezed toward the top plate with a structure between the top plate and the bottom plate, the compressible material provides a force at the end of the bottom plate opposite the holes which cause the bottom plate to be at a non-normal angle with respect to the post and thus wedges the bottom plate against the posts and securely attaches the secure dish holder to the structure. The secure dish holder is easily detached from the table or structure by compressing the end of the bottom plate opposite the holes which allows the bottom plate to be disposed at a substantially normal angle with respect to the posts. With the bottom plate at a normal angle with respect to the posts, the force of the compressed compressible material causes the bottom plate to slide along the posts, away from the structure which releases the secure dish holder from the structure.

7 Claims, 15 Drawing Sheets

U.S. PATENT DOCUMENTS 6,318,683 B1 * 11/2001 Savoy ..... 248/146
6,484,989 B1 11/2002 Connery
6,561,375 B1 5/2003 Nagy
6,581,541 B2 6/2003 Hollinger
6,766,912 B1 * 7/2004 Gibbs ..... 211/74
7,114,276 B2 * 10/2006 Scherba ..... 40/610
2004/0043182 A1 3/2004 Snedeker

* cited by examiner

SECURE DISH HOLDER

CROSS REFERENCE TO RELATED APPLICATIONS

This application is based upon and claims the benefit of U.S. provisional application No. 60/586,863, entitled "Secure Dish Holder", filed Jul. 9, 2004, the entire disclosure of which is hereby specifically incorporated by reference for all that it discloses and teaches.

BACKGROUND OF THE INVENTION a. Field of the Invention

The present invention pertains generally to holders and clamps and more specifically to secure dish holders.

b. Description of the Background

Many situations exist where food dishes or other articles can fall, spill or otherwise be upset because they are not securely held. For example, a young child at a meal in a restaurant may upset or spill the contents of a plate or other food container or may knock a dish off of the table. Sipper cups and other type of cups have been designed to minimize the amount of liquid spilled when a young child tips a cup over or knocks a cup off of a table. Some spill resistant cups have screw-on lids that have a few small holes to limit the amount of liquid that spills. However, preventing spillage from a plate or a bowl has been more challenging and parents often resort to holding a child's plate by hand to keep it from being tipped, spilled, or knocked off. Alternatively, dishes and bowls are not used at all and food for children is placed directly on the table or on a paper placemat provided by the restaurant.

Having a child eat directly from a table surface has a number of negative consequences. The table surface may be unsanitary and may contain germs or chemical residues that may contaminate the child's food. Further, cleaning up the table after a child has eaten directly from the surface may be difficult and messy. There are also many occasions where eating directly from the table surface would be impolite or impractical such as when the table is covered with a tablecloth. Using utensils to scoop food directly from a table surface is difficult so the child often uses fingers instead of utensils, making cleanup more difficult and delaying the process of learning to use utensils properly. Eating from a paper placemat or other placemat that is not designed to contain food may be unsuitable for foods that contain liquid or are runny.

An alternative to eating directly from the table or from a restaurant placemat is to use a placemat that is designed to contain food and attach to a table. Existing placemats for children have food compartments that overhang the edge of the table. Some placemats for children have suction cups which secure the placemat to an airtight smooth table top. However, such placemats fail to secure the placemat to table tops that are not sufficiently smooth and airtight to permit a sufficient vacuum to be created by the suction cups. Children's placemats have the disadvantage of not being suitable for use with utensils as described above. Further, after a child has eaten on a placemat, it must be folded or rolled up and carried home to be washed. Existing placemats are bulky to carry and food residue may soil clothing or bags in which the placemat is carried.

Some existing non-spill dishes for children have suction cups attached directly to the bottom of the dish. The suction cups may be pressed against a smooth table surface such that the resulting suction is intended to retain the dish in place.

Suction cup dishes have numerous disadvantages. Suction cup dishes often have a suction release tab so that a parent may remove the cup. Many children learn to pull the release tab or otherwise release the suction and then are able to upset the dish. Suction cup dishes have the further disadvantage that the suction function does not work correctly unless a smooth upper surface is available on the table top. For example, the suction cup cannot attach to outdoor tables that have a grating table-top. Likewise, the suction cups fail to adhere to tablecloths or similarly porous surfaces. Suction cup dishes will not work with many picnic tables or other tables with slots, holes, rough surfaces or uneven surfaces.

Some suction cups lose suction power when the rubber-like material becomes deformed or loses resiliency due to heat, such as when the suction cup dish is washed in a dishwasher or left in the sun. Similarly, a nick, hole, or bend in the suction cup may cause it to fail to adhere. Even when fully functioning, suction cups may not have sufficient retaining force to prevent a child from dislodging them.

The problems of securely retaining dishes are not restricted only to small children. Adults with motor control deficiencies may also have trouble using unsecured dishes. In addition, eating in a moving environment such as in a vehicle, watercraft, aircraft or other moving environments using conventional unsecured dishes without holders may lead to spills or breakage.

SUMMARY OF THE INVENTION

The present invention overcomes the disadvantages and limitations of the prior art by providing a secure dish holder for use with various types of table tops and other surfaces.

The present invention may therefore comprise a secure dish holder that is adapted to be attached to a structure comprising: a top plate, said top plate having a first fastener attached to a topside of said top plate and a slip-resistant padding attached to an underside of said top plate; a second fastener that is fixed to said underside of a dish so that said dish may be fastened to said top plate; at least one post having an upper end and a lower end, said post connected at said upper end to said underside of said top plate and extending from said underside of said top plate; a bottom plate having a topside and an underside, said bottom plate having at least one hole, said hole having a size that is slightly greater than said size of said post, said hole of said bottom plate being fitted over said post so that said bottom plate slides snugly along said post; and a compressible material connected to a portion of said topside of said bottom plate, in a location that causes said compressible material to generate a force on said bottom plate that causes said bottom plate to wedge into a locked position against said post when said bottom plate is squeezed toward said top plate and said compressible material is compressed against said structure.

The present invention may further comprise a dish for a secure dish holder that has a trough that is capable of containing food, said underside of said trough having a fastener attached that is capable of connecting to a complementary fastener that is attached to a top plate of a secure dish holder, said dish having a rim that has a bottom perimeter that is slightly larger than a perimeter of said top plate so that said dish substantially covers said top plate when said dish is connected to said top plate so that said bottom perimeter of said dish is substantially flush with a surface to which said secure dish holder is attached and said dish is inhibited from being dislodged by a child's fingers.

The present invention may further comprise a method of manufacturing a secure dish holder for securely holding a dish to a structure comprising: forming a top plate and a bottom plate; connecting an upper end of at least one post to an underside of said top plate so that said post extends substantially perpendicularly from said underside of said top plate; forming holes in said bottom plate to fit snugly over said post so that said bottom plate slides snugly along said post; fixing a first fastener to topside of said top plate; fixing slip resistant padding to said underside of said top plate; fixing a compressible material to a topside of said bottom plate, said compressible material covering a portion of said bottom plate and located in a position so that said compressible material generates a force on said bottom plate that causes said bottom plate to wedge into a locked position against said post when said bottom plate is squeezed toward said top plate and said compressible material is compressed against said structure; sliding said bottom plate over said posts; and providing a second fastener that fixes to an underside of a dish, said second fastener being a complementary fastener that fastens to said first fastener that is fixed to said topside of said top plate.

The present invention may further comprise a method of securely holding a dish comprising: providing a secure dish holder that includes: a top plate, said top plate having a first fastener attached to a topside of said top plate and a slip-resistant padding attached to an underside of said top plate; a second fastener that is fixed to an underside of a dish so that said dish may be fastened to said first fastener that is fixed to said top plate; at least one post having an upper end and a lower end, said post connected at said upper end to said underside of said top plate and extending substantially perpendicularly from said underside of said top plate; a bottom plate having a topside and an underside, said bottom plate having at least one hole, said hole having a size that is slightly larger than said size of said post, said hole of said bottom plate being fitted over said post so that said bottom plate slides snugly along said post, and a compressible material connected to a portion of said topside of said bottom plate in a location opposite to said hole; attaching said secure dish holder to a structure by positioning said secure dish holder so that said structure is between said top plate and said bottom plate and by squeezing said bottom plate toward said top plate so that said compressible material is compressed against said structure and generates a force that causes said bottom plate to become wedged in locked position against said post to securely attach said dish holder as a result of a force on said bottom plate at said location that causes said bottom plate to be disposed at a non-perpendicular angle with respect to said posts.

DETAILED DESCRIPTION OF THE INVENTION

Figure 1A:
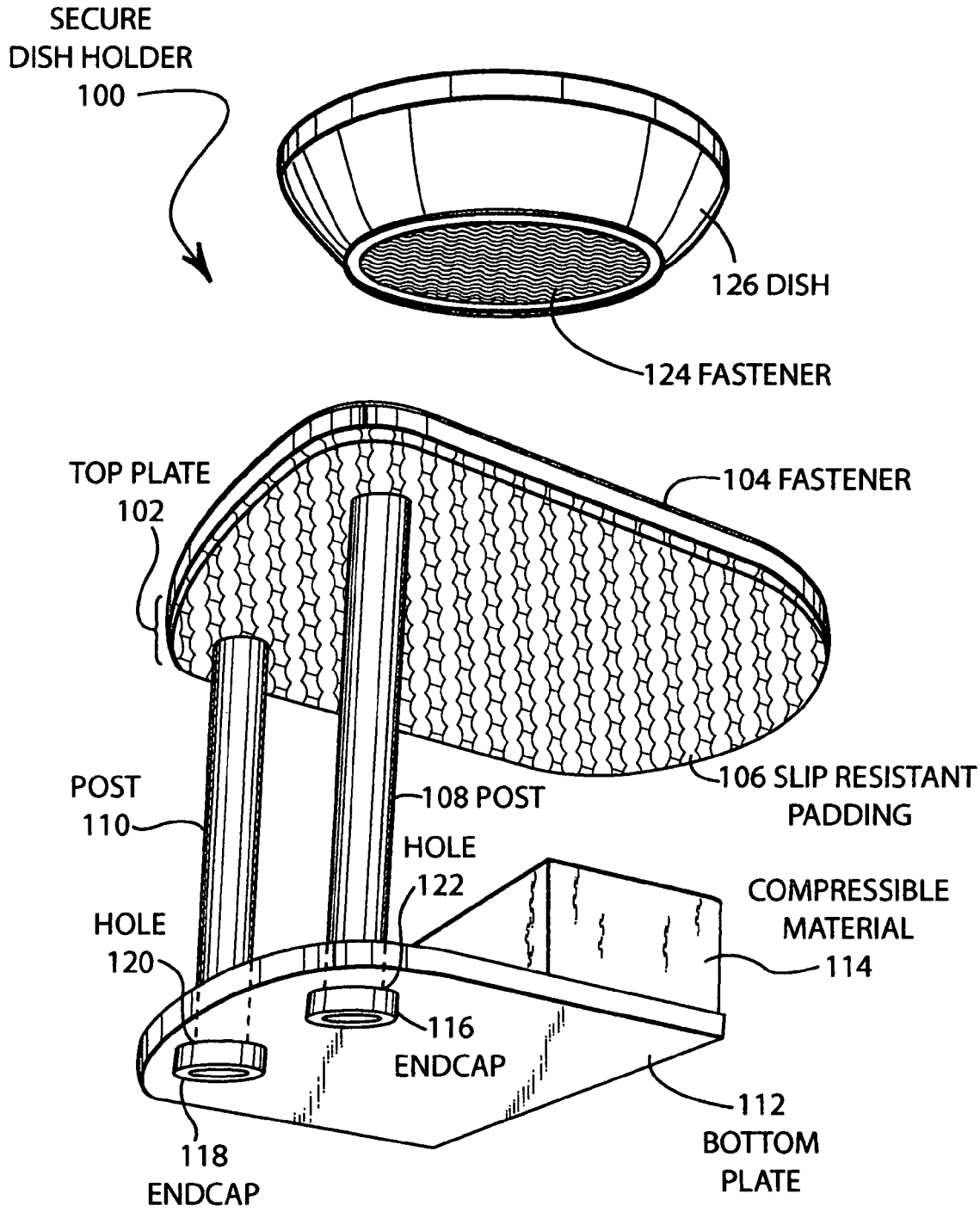
FIG. 1A is an illustration of an embodiment of a secure dish holder in an open position.

FIG. 1A illustrates an embodiment of a secure dish holder 100 in an open/unlocked position. The secure dish holder 100 includes a top plate 102 and posts 108 and 110 that are connected to the top plate 102. A first fastener 104 is fixed to the upper surface of the top plate 102. A second fastener 124 is fixed to the bottom surface of a dish 126 or other object such as a plate, cup, glass, etc. (hereinafter "dish"). The first fastener 104 may be fastened to the second fastener 124 so that the dish 126 is held securely to the top plate 102. Slip-resistant padding 106 is fixed to the bottom surface of the top plate 102. The slip-resistant padding has holes through which posts 108 and 110 connect to the top plate 102.

The secure dish holder includes a bottom plate 112 with holes 120 and 112. The holes 120 and 122 are sized so that bottom plate is placed onto posts 108 and 110 with the posts 108 and 110 fitting through holes 120 and 122. The bottom plate 112 slides snugly along the length of posts 108 and 110. Endcaps 116 and 118 are securely fixed at the bottom of posts 108 and 110. The endcaps prevent the bottom plate 112 from sliding off the ends of the posts 108 and 110. Endcaps 116 and 118 may be any separately manufactured components such as rings, pins, blocks, spheres or other structures that are fixed to the ends of posts 108 and 110 to prevent the bottom plate 112 from sliding off. Alternatively, endcaps 116 and 118 may be integral parts of posts 108 and 110 which are formed with retaining structures or protrusions extending outward from the posts, or a portion of posts 108 and 110 may be sized larger than the remaining portion of the posts 108 and 110 so that the bottom plate 112 cannot slide off. A compressible material 114 is fixed to the upper side of the bottom plate 112. The bottom plate 112 slides towards the top plate 102 so that the compressible material 114 is squeezed toward the top plate 102 with a table, countertop or other structure disposed between the compressible material 114 and the slip-resistant padding 106 of the top plate 102. The squeezed compressible material forces the end of the bottom plate 112 farthest from the posts 108 and 110 away from the top plate 102 so that the bottom plate is not parallel with the top plate and forms a non-normal angle with the posts 108 and 110 which causes the bottom plate to lock against the posts 108, 110. In other words, the force created by the compressible material forces the end of the bottom plate 102 farthest from the posts 108 and 110 away from the top plate. Since the force is applied non-uniformly to the bottom plate, i.e., at the end of the bottom plate that is opposite to the posts 108, 110, the bottom plate is non-uniformly forced away from the plate, and the posts 108, 110 become wedged in the holes 120, 122 formed in the bottom plate 112. Wedging occurs as a result of the close tolerances between holes 120, 122 and the posts 108, 110. The bottom plate 102 is locked into a fixed position which firmly attaches the secure dish holder 100 to a structure such as a table or counter.

The top plate 102 may be made of plastic, acrylic or other hard plastic-like materials. Other hard materials such as wood or metal may be used. In one embodiment, the thickness of the top plate 102 is 0.25 inches which resists breakage and provides a solid, but unobtrusive surface. Thicknesses in the range of 0.2 inches to 0.4 inches may be suitable for plastic or acrylic. Top plates and bottom plates with other thicknesses may be effectively used depending on the strength, cost, and manufacturability of the materials. Suitable plastics for the top plate 102, the bottom plate 112, the posts 108 and 110 and endcaps 116 and 118 may be obtained from numerous sources, such as, for example Polytek Development Corp., 55 Hilton Street, Easton, Pa. 18042. The bottom plate 112 may be the same thickness as the top plate 102 or may differ in thickness. The top plate 102 and bottom plate 112 may be clear, translucent, opaque, or any desired color.

As shown in the embodiment of FIG. 1A, the top plate has an oblong/rectangular shape with a length of approximately 6⅓ inches and a width of approximately 4⅛ inches. The rounded corners of the top plate 102 reduce the chance of a corner breaking or someone getting poked by a sharp corner. The size of the top plate 102 in this embodiment provides sufficient surface area for the fastener 104 to accommodate and securely retain various shapes and sizes of dishes or other articles. At the same time, the size is small enough so that the secure dish holder does not protrude excessively into the table area and so that the secure dish holder is easily portable. The top plate 102 may have any desired shape or size. For example, the top plate 102 can be formed to resemble a face, logo, animal shape or any desired shape.

In accordance with the embodiment of FIG. 1A, the bottom plate 112 has a width of approximately 4⅛ inches. The length of the bottom plate 112 is approximately 3⅜ inches which allows the compressible material to extend far enough under a table or other structure to accommodate various table top or structural designs. The length of the bottom plate 112 also allows a parent to easily reach under the table and squeeze the plate directly under the compressible material to release the bottom plate from the locked position.

The holes 120 and 122 in the bottom plate have a diameter which is slightly larger that the diameter or outer dimensions of the posts 108,110. In the embodiment of FIG. 1A, the diameter of the holes 120,122 is 0.505 inches while the posts 108,110 have a diameter of approximately 0.5 inches. Other embodiments such as the embodiment of may have larger differences in the diameter of the holes and the diameter of the posts depending on the type and size of the materials used. The difference in diameter is large enough to permit the bottom plate 112 to slide smoothly along posts 108, 110 when the secure dish holder 100 is not attached to a table or other surface, but small enough to enable the bottom plate 112 to lock securely against the posts 108,110. The holes are spaced with the centers approximately 2.5 inches apart from each other. The holes 120 and 122 are disposed along a line that is approximately three quarters of an inch in from the outer edge of the bottom plate, i.e., the edge that is facing outwardly from the table or structure to which the secure dish holder is being attached.

The embodiment of FIG. 1A includes two posts 108 and 110. However, a single post or a plurality of posts may be used. Posts 108 and 110 have a round cross section with a diameter of approximately 0.5 inches. Posts with larger or smaller diameters or posts with rectangular, elliptical or other shapes may be used if desired. The length of posts 108 and 110 in this embodiment is approximately 5 inches which provides an opening between the top plate 102 and the compressible material 114 attached to the bottom plate 112 that is large enough to accommodate many structure thicknesses, and at the same time small enough for the secure dish holder to be easily transportable in a diaper bag, purse or other small container. Posts 108 and 110 are connected to top plate 102 using any desired way of fastening including gluing, welding, molding, or forming as a single structure. In other embodiments, posts 108 and 110 may be connected to top plate 102 using hinges or removable fastening technique such as turning a twist-lock structure built into the top plate 102 and the upper end of posts 108, 110, screwing the posts into the top plate, forcing the posts into tight fitting holes, etc., so that the secure dish holder 100 may be folded or partially disassembled to facilitate shipping, storing and carrying.

Fastener 104 may comprise the loop fabric portion of a hook and loop fabric fastener. The fastener 104 may have self-adhesive backing or may be attached to the upper surface of the top plate 102 using cement or other suitable adhesive. In other embodiments, fastener 104 may be snaps, magnets, or any fastener desired. Fastening parts of various hook and loop fasteners and other fasteners have varying degrees of holding strength. The holding strength of the fasteners should be such that the attached dish or article is securely retained, as desired, but is also removable, as desired. Hook and loop fasteners may be obtained from a variety of manufacturers including Velcro USA Inc., 406 Brown Ave., Manchester, N.H. 03103. A fastener 124 is fixed to the bottom surface of dish 126. For example, in the case that dish 126 is a child's bowl, the holding strength of fastener 124 and fastener 104 may be chosen so that the bowl is not easily removable by a child but is easily removable by an adult. To provide a sanitary and attractive surface, fasteners 104 and 124 that can be washed and cleaned and which retain holding power may be used, for example hook and loop fasteners.

Slip-resistant padding 106 protects the surface of a table, or other structure to which the secure dish holder is attached, from being marred or scratched by the top plate 102. The slip-resistant padding may be die cut or otherwise formed to have holes that permit the posts 108 and 110 to pass through the slip-resistant padding 106 and connect to the top plate 102. One source of slip-resistant padding is Griptex Industries, Inc., 63 Industrial Drive Cartersville, Ga. 30120. It is not necessary that the padding 106 completely surround the posts 108, 110, but should cover enough of the top plate 102 to securely hold the top plate on the surface of the structure to which the secure dish holder is attached and not mar the surface.

Figure 1B:
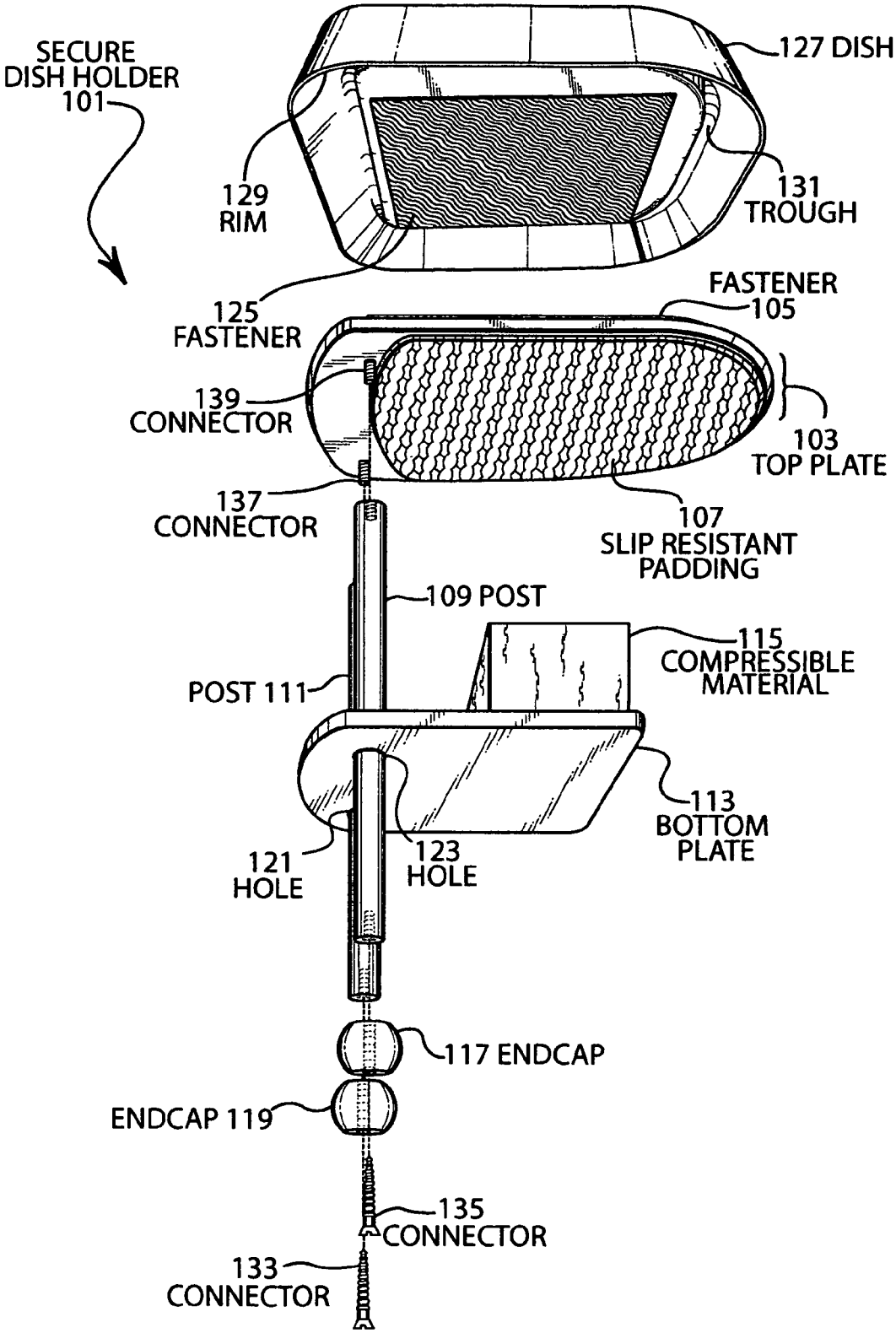
FIG. 1B illustrates an exploded view of another embodiment of a secure dish holder in an open position.

FIG. 1B illustrates an exploded view of another embodiment of a secure dish holder 101 in an open/unlocked position. The embodiment of FIG. 1B functions substantially similarly to the embodiment of FIG. 1A. Dish 127 has a trough 131 that retains food. A fastener 125 is attached to the underside of trough 131. In the embodiment of FIG. 1B, fastener 125 is a flexible hook fabric with a self-adhesive backing that is one part of an industrial strength hook and loop fastener system, for example, industrial Velcro. Fastener 105 is a complementary loop fabric of the hook and loop system. Fastener 105 attaches to a topside of top plate 103 so that a user may attach dish 127 to top plate 103 by placing dish 127 onto top plate 103 so that fastener 125 contacts fastener 105. The hook fastener part and loop fastener part of the hook and loop fastener system may be reversed, i.e. the hook fastener part may be attached to the top plate 103 and the loop fastener may be attached to the dish 105.

Dish 127 also includes a rim 129. The perimeter of rim 129 is slightly larger than the perimeter of top plate 103. Trough 131 is raised with respect to the bottom edge of rim 129 so that when dish 127 is attached to top plate 103, rim 129 is substantially flush with the underside of top plate 103 and rim 129 substantially covers top plate 103. When the secure dish holder 101 is in use, the bottom perimeter of rim 129 will be substantially flush with the surface of the table or surface to which secure dish holder 101 is mounted. Rim 129 being mounted substantially flush to a table or surface reduces the ability of a child to accidentally or intentionally stick his fingers under rim 129 to easily upset dish 127.

Top plate 103 includes connectors 137, 139 that extend below the bottom surface of top plate 103. Posts 109, 111 may be connected to connectors 139, 137 respectively so that posts 109, 111 may be securely connected to top plate 103. Connectors 137, 139 that are threaded such as screws may be connected and disconnected which allows secure dish holder 101 to be easily assembled and disassembled by a user. This provides lower assembly and shipping costs. Likewise, partial disassembly of secure dish holder 101 permits more convenient storage and transportation for users. Posts 109, 111 may be made of metal such as aluminum, or and hard material such as plastic. Posts 109, 111 may be made of materials that are safe for contact with food such as FDA approved aluminum, plastic or other safe materials. Posts 109, 111 are substantially smooth and have dimensions of the necessary precision to enable posts 109, 111 to pass through holes 121 and 123 of bottom plate 113 so that plate 113 may glide along the length of posts 109, 111 smoothly, without sticking, except when compressible material 115 exerts a wedging force near the end of bottom plate 113 that is farthest from holes 121, 123 which wedging forces acts to clamp secure dish holder 101 to a surface. Endcaps 117, 119 as shown in FIG. 1B may be substantially spherical or bead-like and may be attached to posts 109, 111 using connectors 135, 133. Connectors 135, 133 may be screws or other connectors that allow for easy, economical assembly.

Figure 2A:
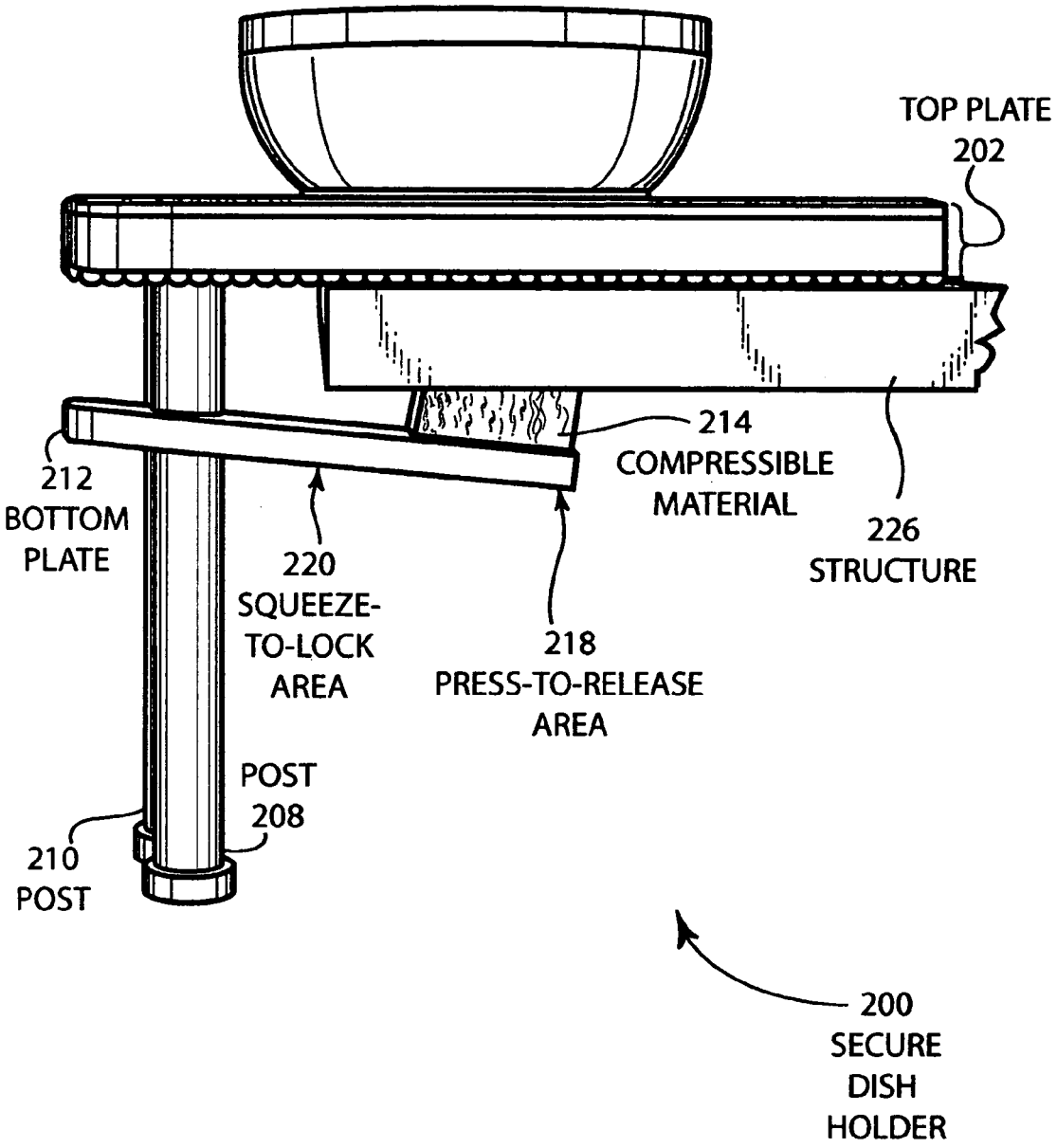
FIG. 2A is a side view of the embodiment of FIG. 1A attached to a structure.

FIG. 2A illustrates a side view of secure dish holder 200 attached to a structure 226. The bottom plate 212 is slid along posts 208, 210 to a position near to the top plate 202 by a user squeezing the squeeze-to-lock area 220 so that the compressible material 214 is compressed. The spring force of the compressible material 214 pushes the end of the bottom plate that is farthest from posts 208, 210 away from the structure 226 so that the bottom plate is not parallel with the top plate and forms a non-normal angle with the posts 208, 210 which causes the bottom plate to lock against posts 208, 210 as described above with respect to FIG. 1A and FIG. 1B. The secure dish holder 200 is released by squeezing the press-to-release area 218 of the bottom plate 212, which compresses the compressible material 214. By compressing the compressible material 214 sufficiently to equalize the force of the compressible material, the bottom plate 212 moves to a substantially normal angle with respect to posts 208, 210 which releases the wedging between the holes in the bottom plate 212 and posts 208, 210. A portion of the compressed compressible material 214 that is disposed between the press-to-release area 218 and the posts 208, 210 provides a force the pushes the end that is nearest the posts 208, 210 of the bottom plate 212 away from the structure, to which the secure dish holder 200 is attached, thus aiding in returning the bottom plate 212 to a substantially perpendicular angle with respect to the posts 208, 210. By slowly releasing the press-to-release area and allowing the bottom plate to move along and substantially normal to posts 208, 210, the secure dish holder is released.

Figure 2B:
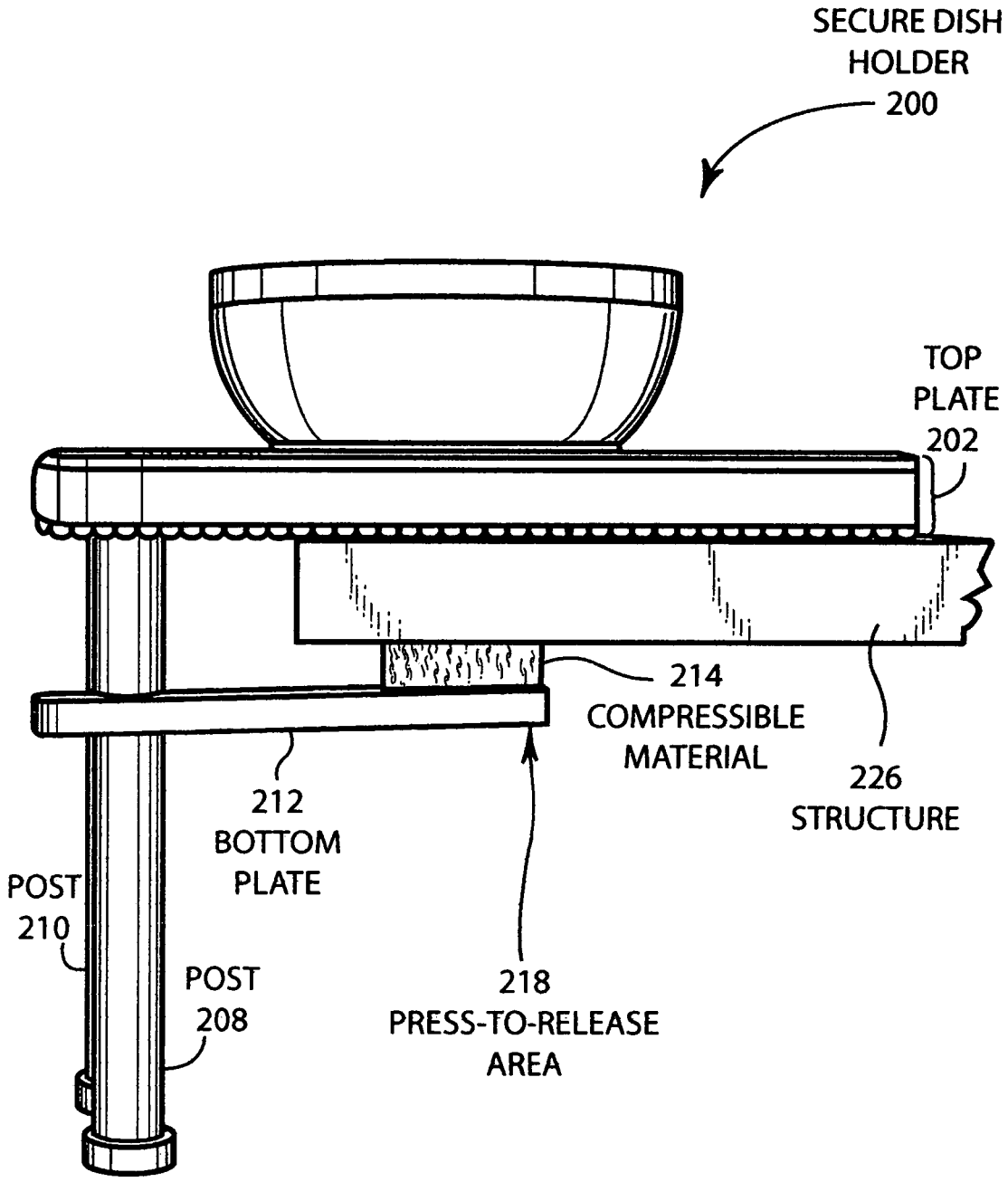
FIG. 2B is a side view of the embodiment of FIG. 1A being released from a structure.

FIG. 2B illustrates a side view of secure dish holder 200 being released from a structure 226. To release the holder 200, a user can squeeze the press-to-release area 218 of the bottom plate 212 to compress the compressible material 214 which equalizes the forces of the compressible material 214 along the bottom plate 212 and moves the bottom plate to a position that is substantially parallel to the top plate 202 and substantially perpendicular to the post 208, 210. When the bottom plate 202 is substantially perpendicular to the posts 208, 210 the bottom plate slides down posts 208, 210 away from the top plate 202 as a result of the substantially uniform force created by the compressible material on the surface of the bottom plate. Hence, it is beneficial for the compressible material 214 to have a size that is large enough to securely engage the structure. When the compressible material 214 is compressed, and the bottom plate 212 is moved to a position that is substantially parallel to the posts 208, 210, the compressible material 214 provides a sufficient force to push the bottom plate 212 away from the structure 226.

Figure 2C:
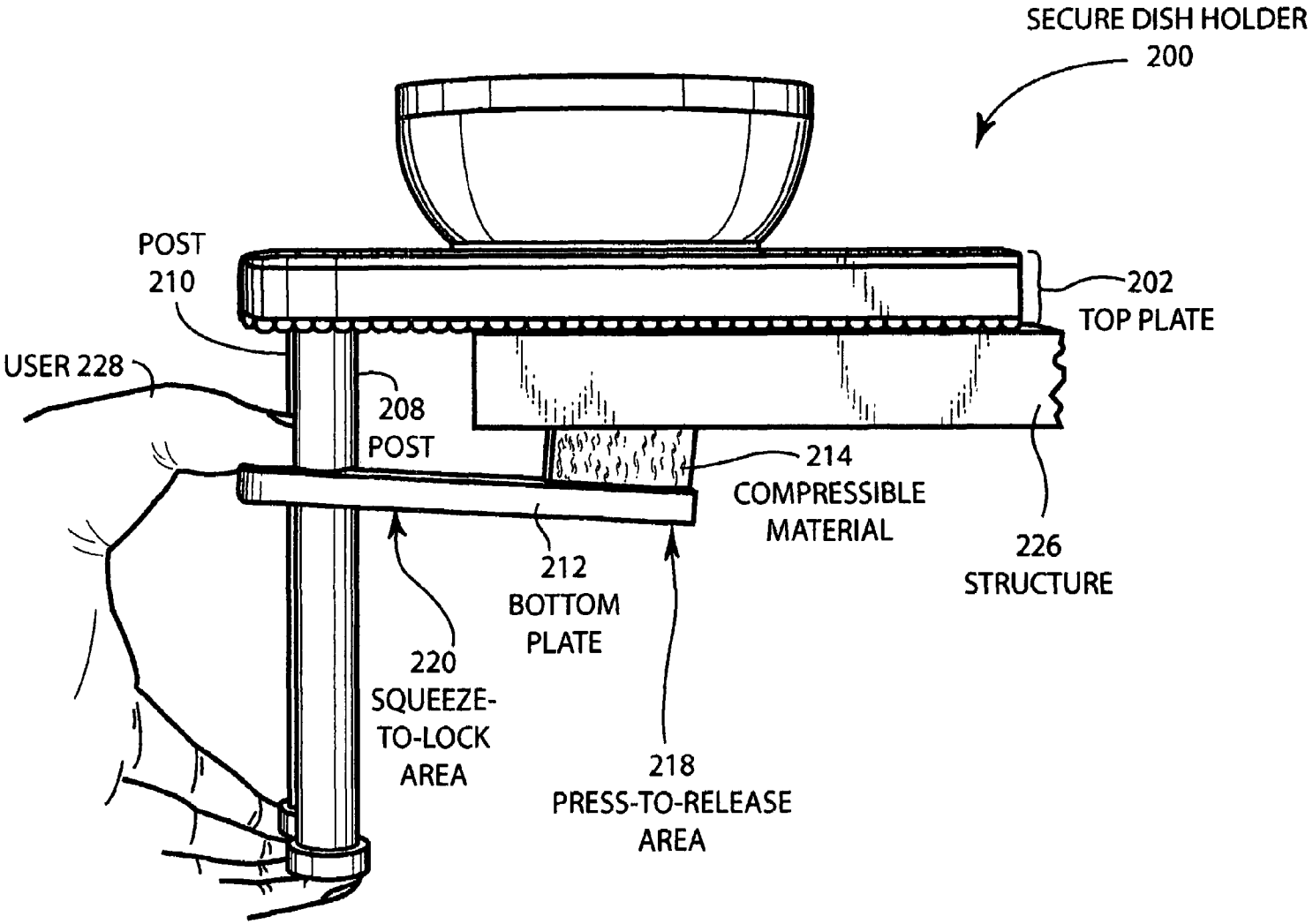
FIG. 2C is a side view of the embodiment of FIG. 1A being released from a structure using another technique.

FIG. 2C illustrates a side view of secure dish holder 200 being released from a structure 226 using another technique. A user 228 applies a force against the topside of the bottom plate 212 at a position adjacent posts 208, 210. The force applied by a user moves the bottom plate 212 downwardly to a position that is substantially perpendicular to the posts 208,210 so that the bottom plate 212 can slide snugly along posts 208, 210 away from the top plate 202 to release the bottom plate 212 from the structure 226. Using this technique, the force required to be applied by the user may be greater than the force required for the release technique described with respect to FIG. 2B.

Figure 3:
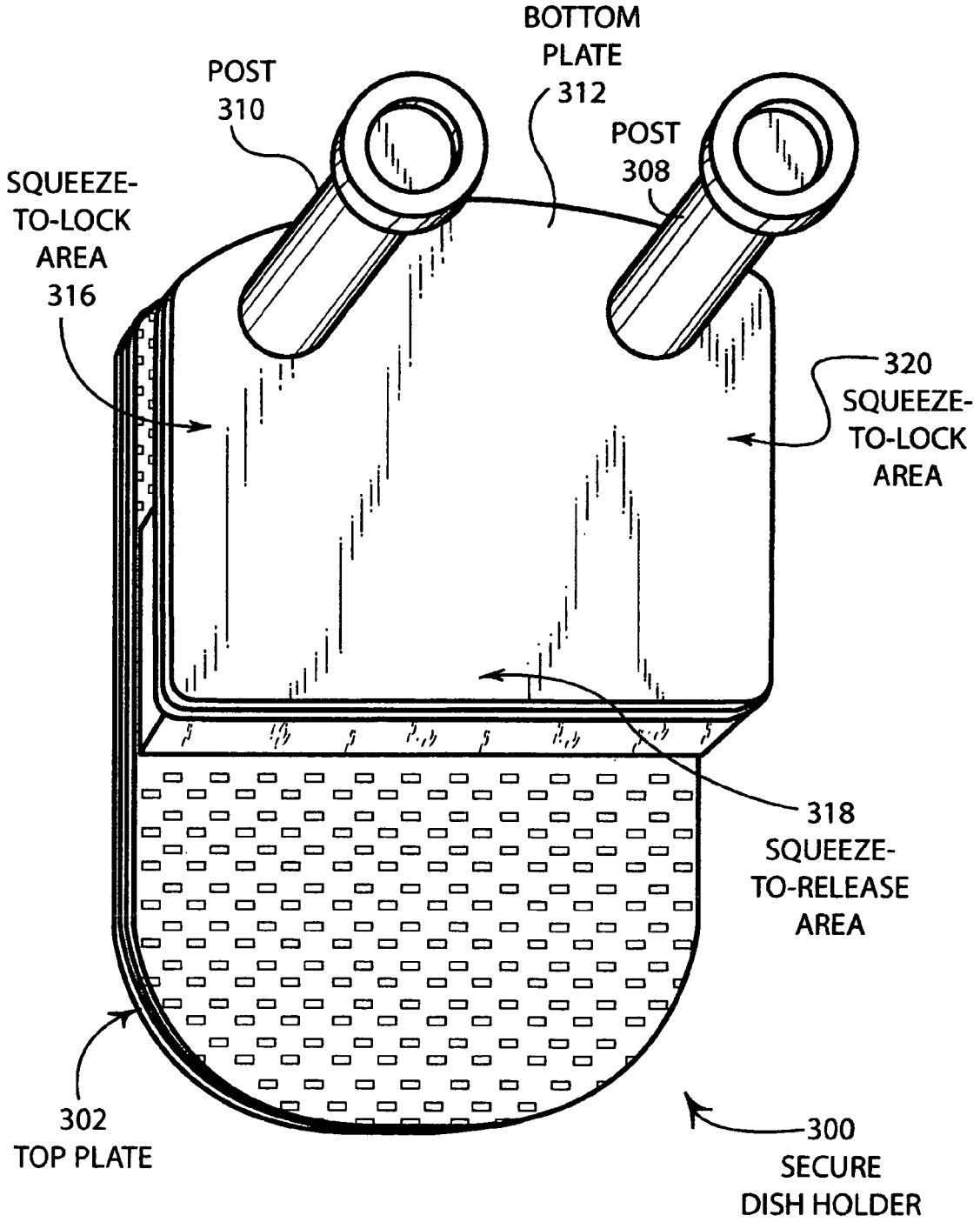
FIG. 3 illustrates a bottom view of embodiment of FIG. 1A.

FIG. 3 illustrates a bottom view of an embodiment of secure dish holder 300. Post 310 and post 308 are connected at an upper end to the top plate 302. The ends of post 308 and post 310 farthest from the top plate are not directly mechanically coupled. This allows post 310 and post 308 to flex independently which enhances the wedging or locking action of the bottom plate 312 against the posts 308 and 310 when the squeeze-to-lock areas 316 and 320 are squeezed. As shown in the drawing, the underside of the bottom plate 312 includes writing that provides instructions for locking and releasing the secure dish holder 300. The bottom plate 312, also has product information such as a phone number, Internet URL, and product trade name. A computer controlled laser cutting system can be used to manufacture the bottom plate 312, including the process of cutting the bottom plate from a larger stock piece and precisely cutting the holds 120, 122 (FIG. 1A) in the correct locations with the correct tolerances. In addition, the writing may be laser-engraved on the bottom plate at the same time the bottom plate is cut from the larger acrylic sheet. Precise forms of injection molding or other types of high precision molding can also be used to manufacture the bottom plate 312. Molding can also be used to manufacture other component pieces of the secure dish holder including the top plate and the endcaps. When injection molding is used, writing or other graphics may be incorporated into the mold. Writing that is incorporated directly into the secure dish holder 300, by laser engraving, molding, or other permanent processes, is durable and generally unaffected by repeated use and cleaning. Any desired type of writing, graphics or indicia may be incorporated.

Figure 4:
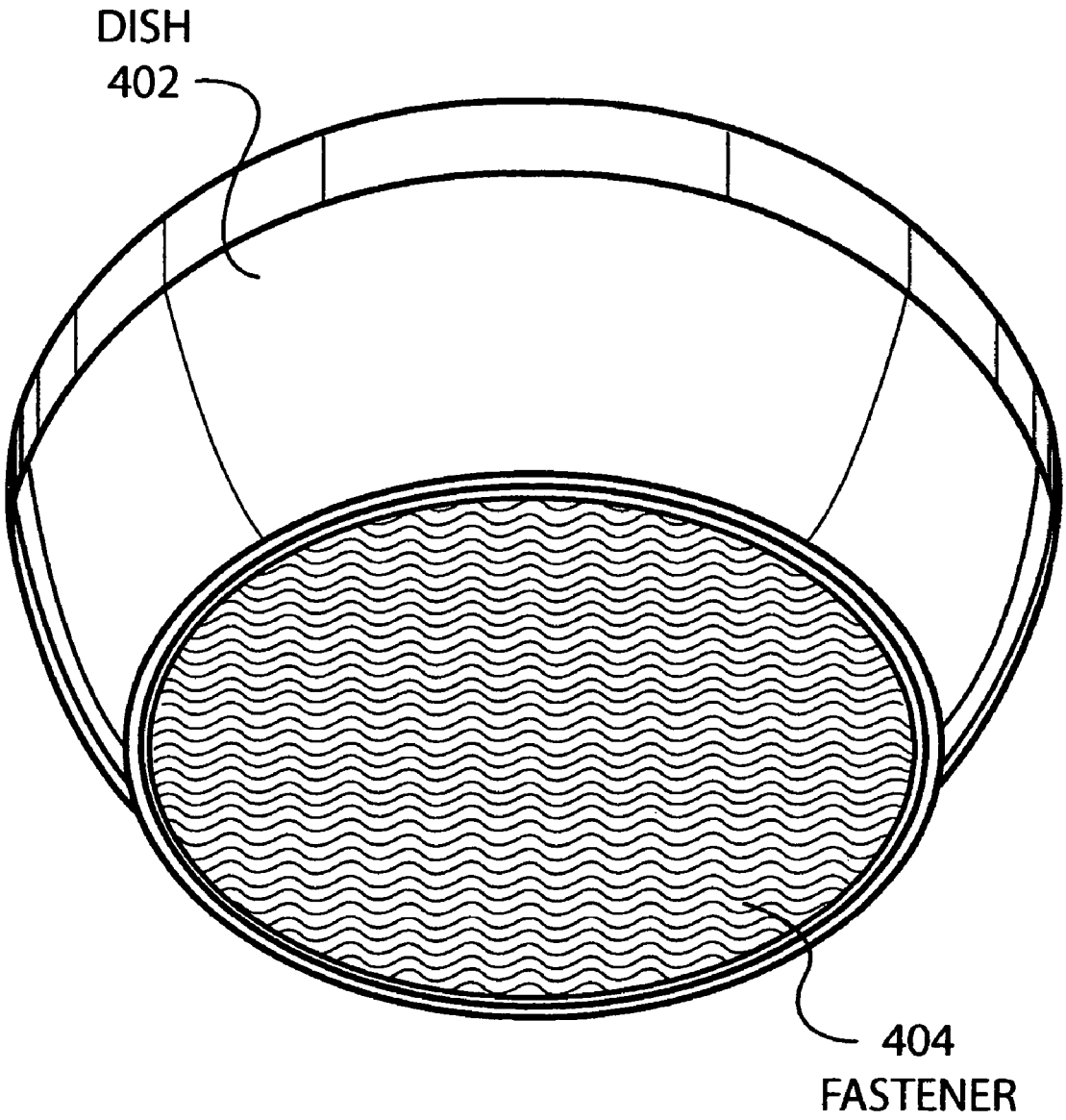
FIG. 4 illustrates a dish with a fastener.

FIG. 4 illustrates a dish 402 with a fastener 404. The dish 402 may be a bowl, a plate, a cup, or any desired dish or container, all of which are referred to herein as a dish. In one embodiment, fastener 404 includes strips of self-adhesive backed hook tape of a hook and loop fastening system. Other articles such as stuffed animals, toys, or any article which one desires to hold securely to a structure using the secure dish holder, referred to herein as articles, may be made securable by fixing a fastener to the desired surface of the article that fastens to the corresponding fastener attached to the top plate of the holder.

Figure 5:
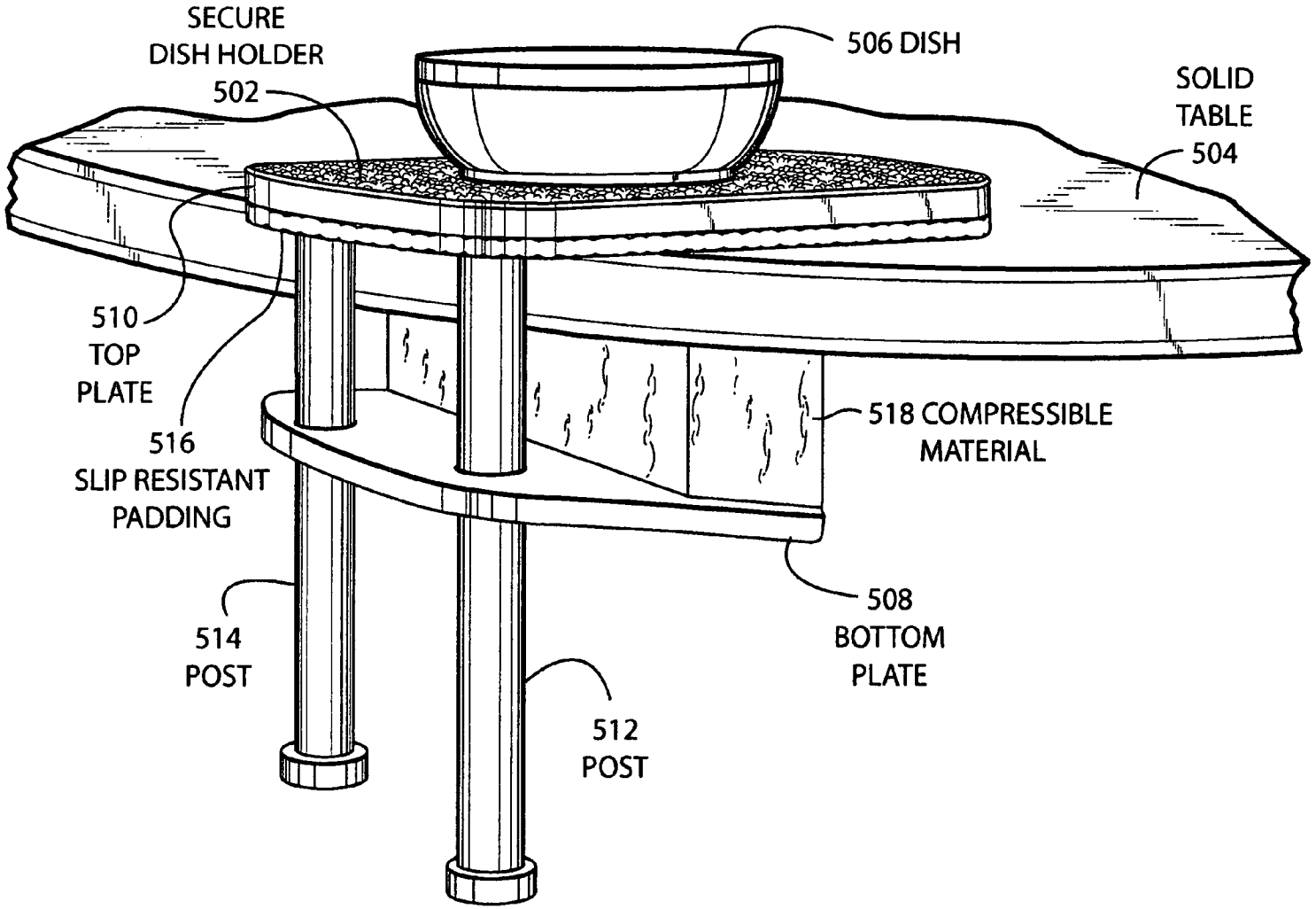
FIG. 5 is an illustration of the embodiment of FIG. 1A attached to a solid table.

FIG. 5 illustrates the use of a secure dish holder 502 attached to a solid table 504. Dish 506 is fastened to the top plate 510. The secure dish holder 502 is secured so that the table 504 is positioned between the top plate 510 and the bottom plate 508. The bottom plate 508 is squeezed toward the top plate 510, which squeezes the compressible material 518, causing the bottom plate to wedge against post 512 and post 514 which securely attaches the secure dish holder 502 to the table. Slip-resistant padding 516 grips the topside of table 504 and also protects the surface of table 504 from being scratched by the top plate 510.

Figure 6:
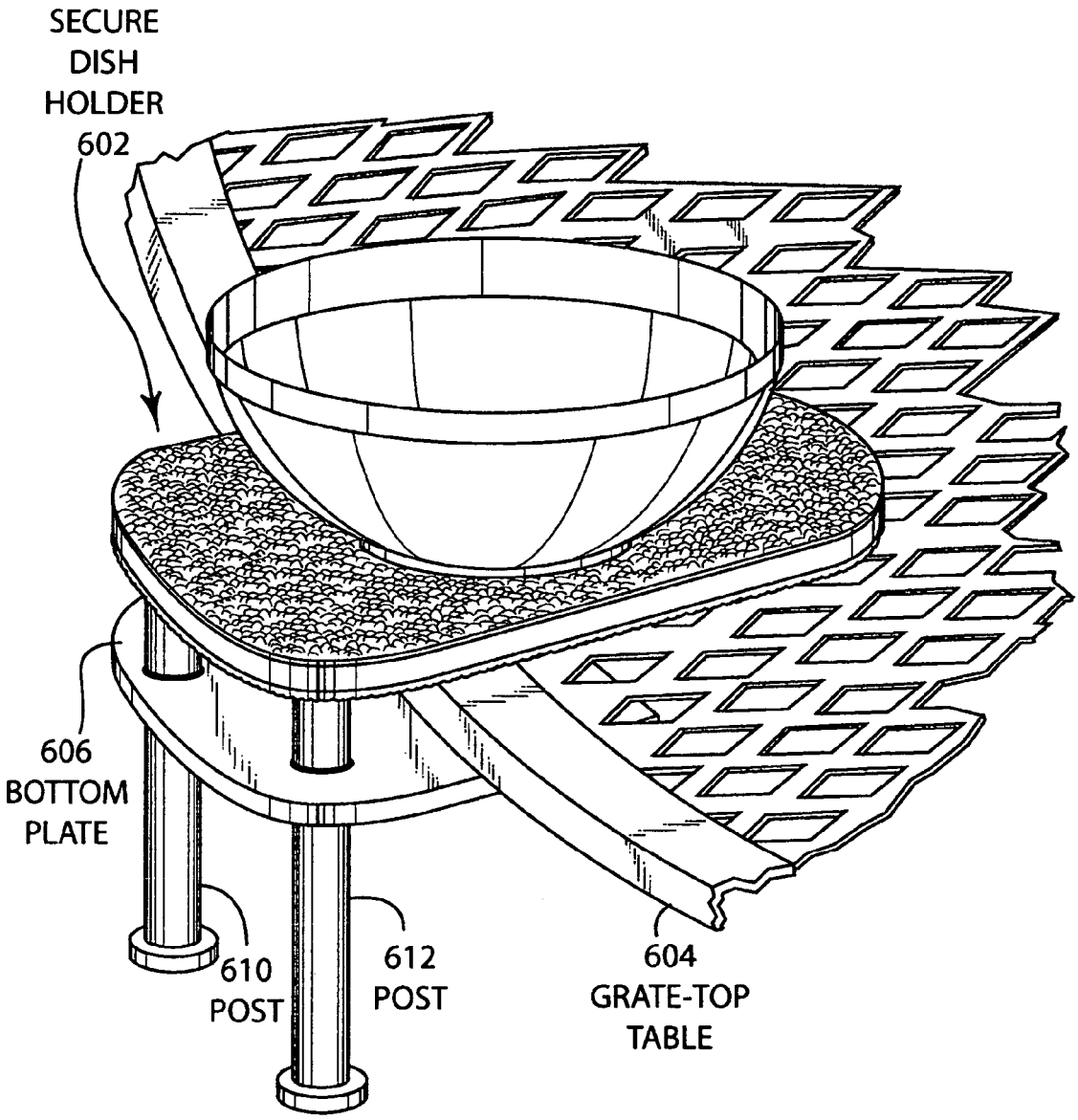
FIG. 6 is an illustration of the embodiment of FIG. 1A attached to a grate-top table.

FIG. 6 illustrates the use of a secure dish holder 602 with a grate-top table 604. In one embodiment, the thickness of the uncompressed compressible material is approximately 1¾ inches. The compressible material (not shown) is disposed at the end of the bottom plate 606 that is farthest from posts 610 and 612. Part of topside of the bottom plate does not have a compressible material attached which enhances the stability of the secure dish holder when the holder is attached to a table with a rim or lip that has a thickness greater than the thickness of rest of the table top. The secure dish holder 602 securely attaches to surfaces that have grating, holes, or are otherwise not airtight because the holder does not depend on suction for attachment.

Figure 7:
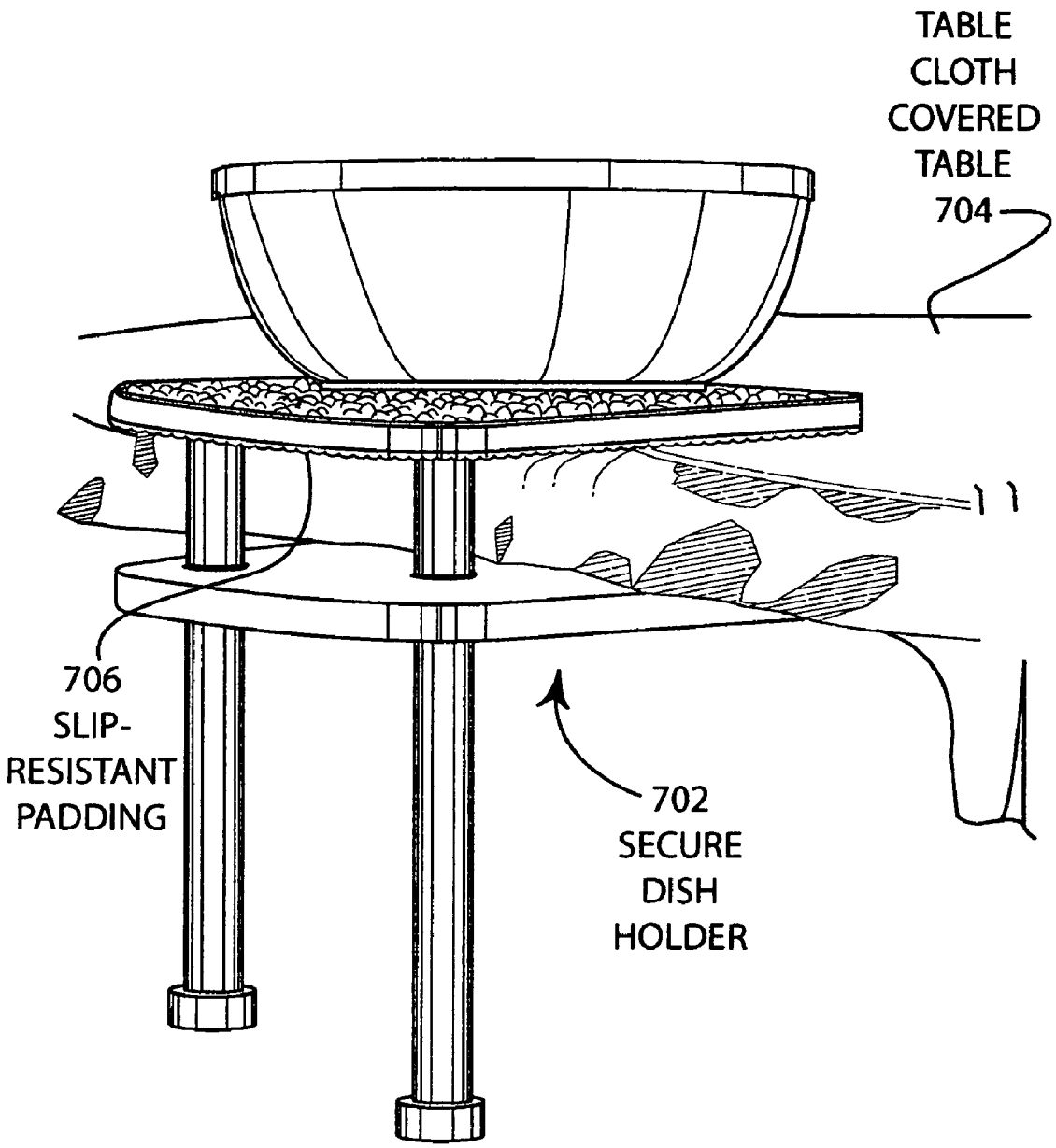
FIG. 7 is an illustration of the embodiment of FIG. 1A attached to a tablecloth-covered table.

FIG. 7 illustrates the use of a secure dish holder 702 with a tablecloth-covered table 704. The slip-resistant padding 706 and the compressible material (not shown) grip securely attach the secure dish holder 702 to the tablecloth-covered table and do not rely on suction for attachment.

Figure 8:
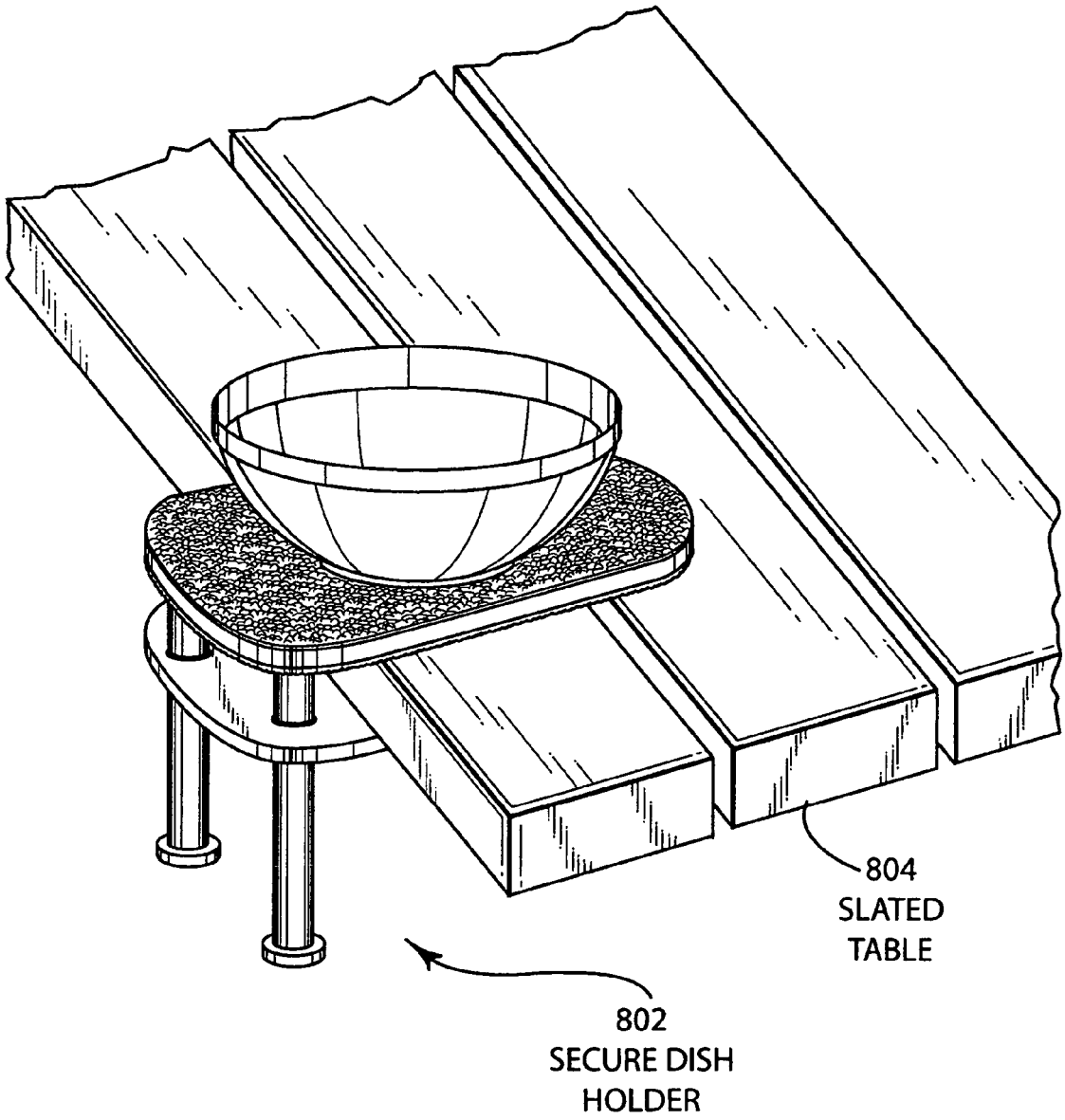
FIG. 8 is an illustration of the embodiment of FIG. 1A attached to a slatted table.

FIG. 8 illustrates the use of a secure dish holder 802 with a slatted table 804. Tables such as picnic tables may have slats. One slat may be warped or otherwise uneven with an adjacent slat. Also, there are often gaps between the slats. The secure dish holder 802 firmly attaches to tables with uneven surfaces because the compressible material and the slip resistant padding conform to the uneven surfaces and gaps, which enhances the gripping strength of the secure dish holder. The presence of gaps does not reduce the gripping strength of the holder 802 because the holder 802 does not rely on suction.

Figure 9:
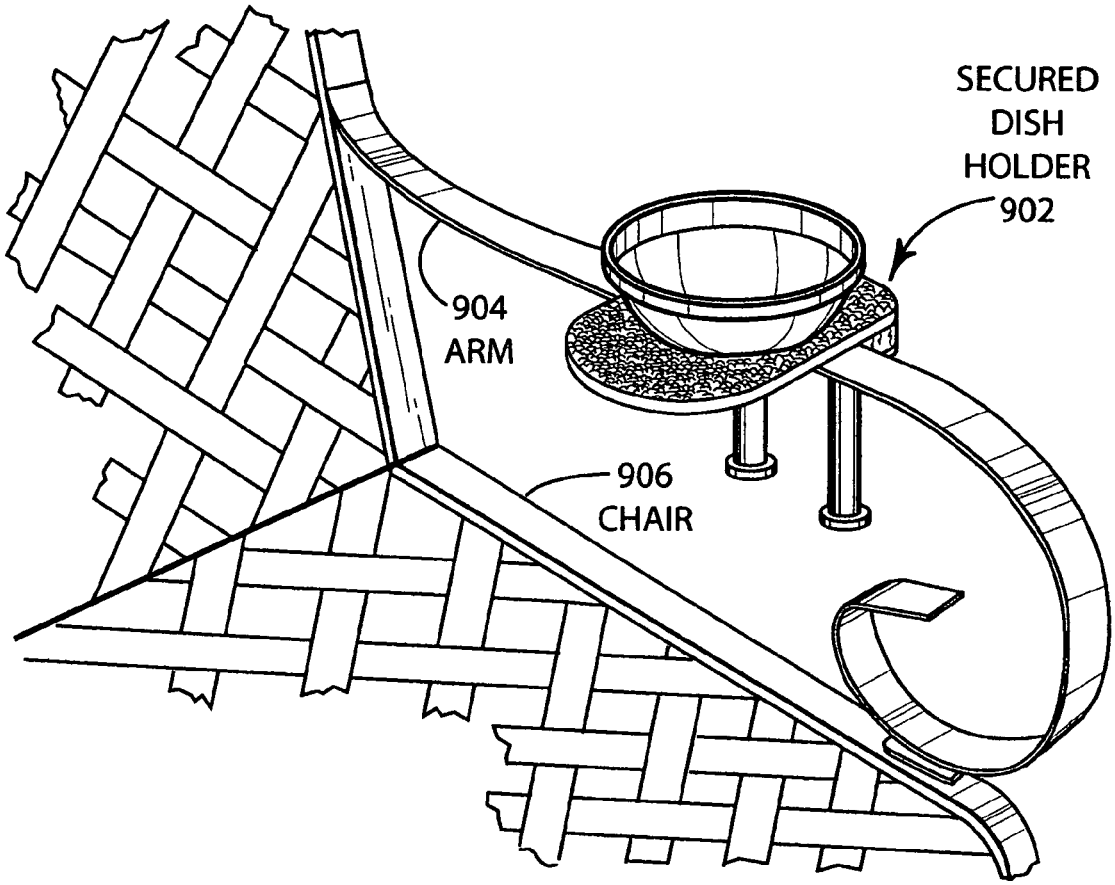
FIG. 9 is an illustration of the embodiment of FIG. 1A attached to an arm of a chair.

FIG. 9 illustrates a secure dish holder 902 that is attached to an arm 904 of a chair 906. As described above, when the bottom plate is squeezed toward the top plate with the arm of the chair or other structure disposed between the slip-resistant padding and the compressible material, the slip-resistant padding and the compressible material conform to the structure and firmly attach the secure dish holder to the structure.

Figure 10:
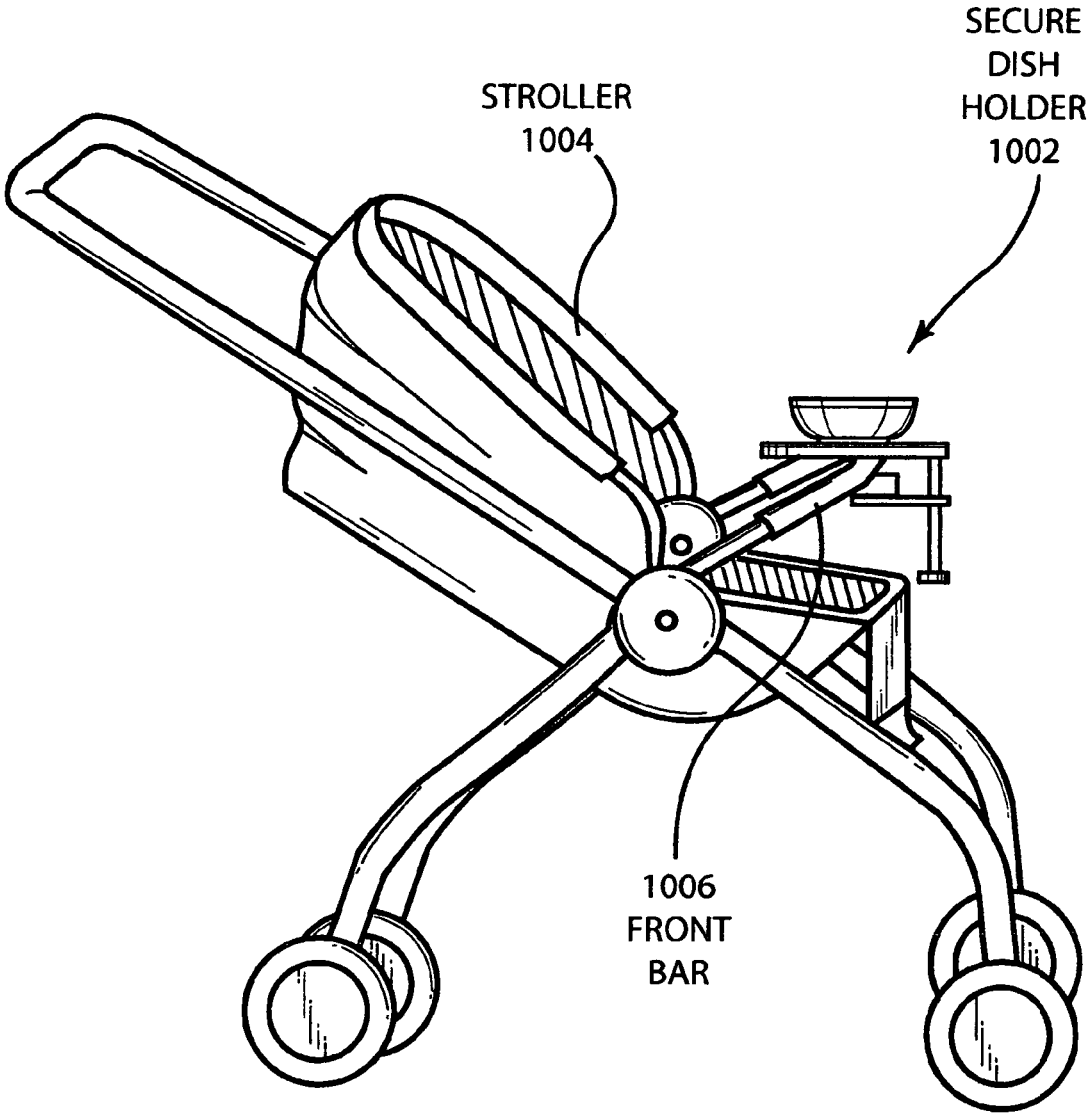
FIG. 10 is an illustration of the embodiment of FIG. 1A attached to a front bar of a stroller.

FIG. 10 illustrates the use of the secure dish holder 1002 that is attached to a stroller 1004. Many strollers have a front bar or a tray that is in front of the seating area. The secure dish holder 1002 easily attaches to the front bar 1006 so that a dish may be securely held.

Figure 11:
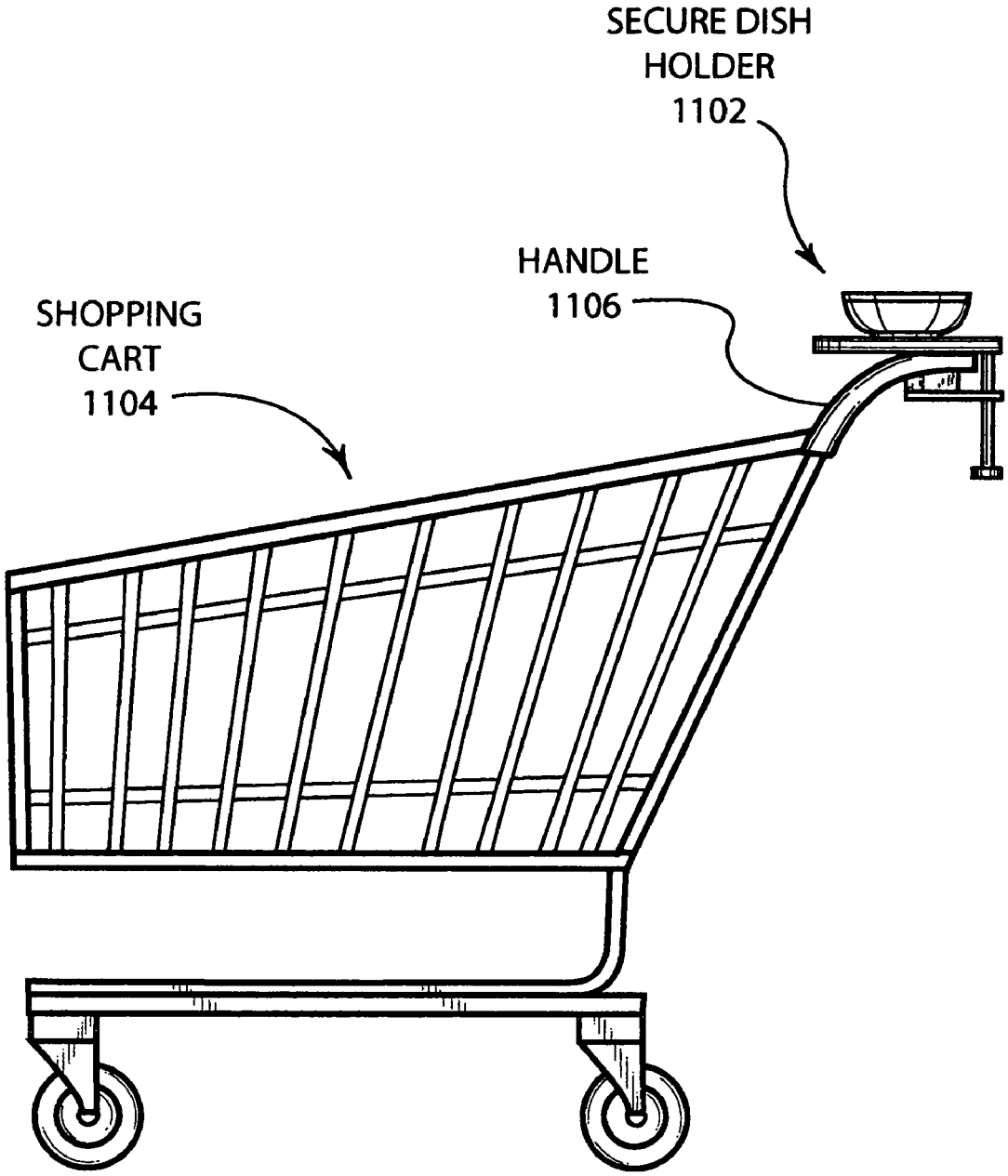
FIG. 11 is an illustration of the embodiment of FIG. 1A attached to a shopping cart handle.

FIG. 11 illustrates the use of the secure dish holder 1102 that is attached to a shopping cart 1104. Many shopping carts have a seating area for small children that is next to a handle 1106 that is used to push the cart. The secure dish holder easily attaches to the handle 1106 so that a child's dish may be securely held.

Figure 12:
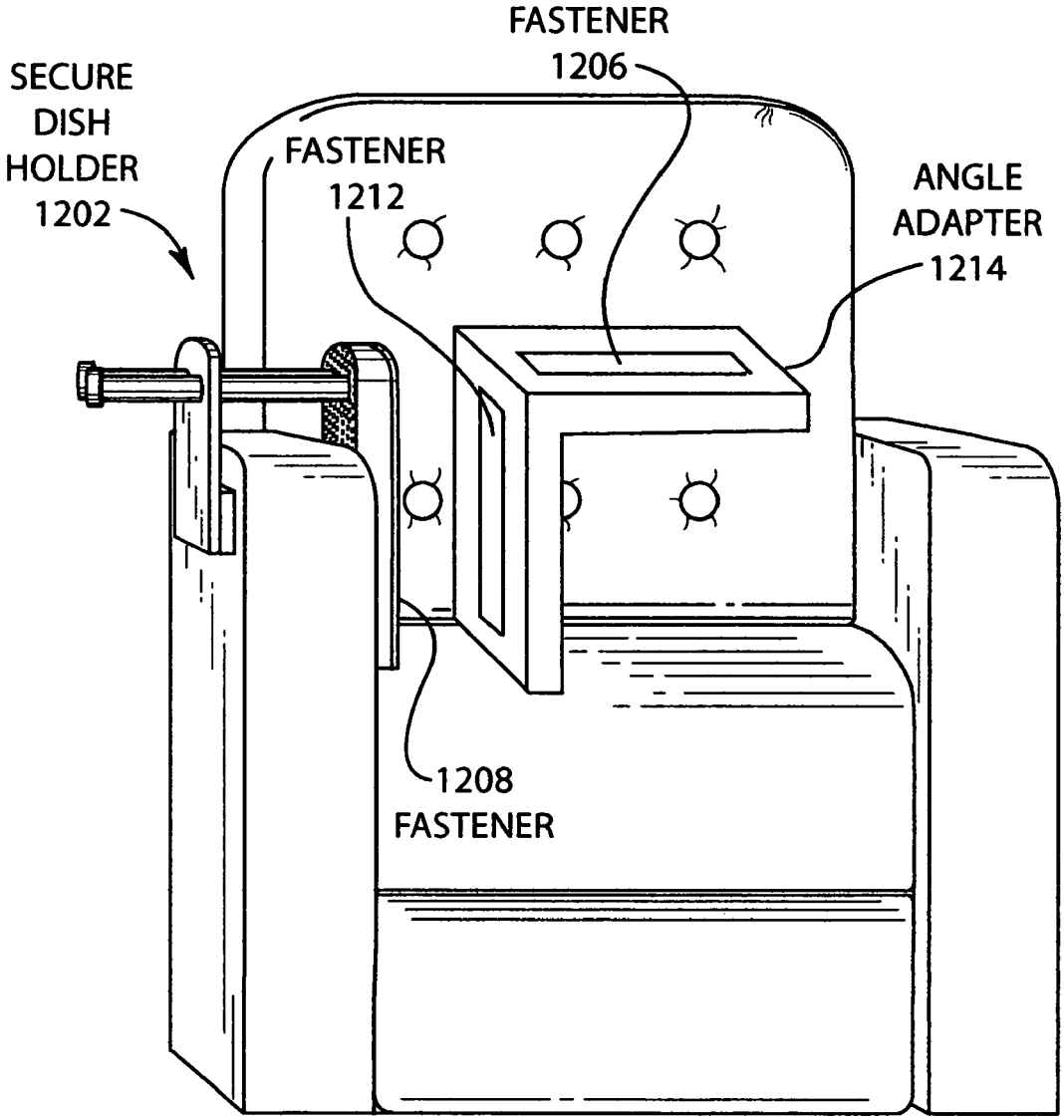
FIG. 12 is an illustration of the embodiment of FIG. 1A and an angle adapter.

FIG. 12 illustrates the use of an angle adapter 1214 that attaches to the secure dish holder 1202. The angle adapter 1214 is formed to have an L-shape as shown in the drawing. The angle adapter has a first fastener 1212 that attaches to fastener 1208 that is fixed to the top plate 1204. When the secure dish holder 1202 attaches to a vertical structure, the angle adapter 1214 attaches the secure dish holder 1202 in a horizontal position and thus provides a horizontal surface with a second fastener 1206 to which a dish or other article fastens.

Hence, the various embodiments of the secure dish holder that are disclosed provide numerous advantages. The secure dish holder firmly attaches a dish or article to a table or structure so that it is not easily removed or upset by a child or by movement due to wind or movement of the structure. The securing mechanism, which includes a sliding bottom plate with an attached compressible material and a top plate with a slip-resistant padding, conforms to grip and attach to a variety of surfaces and structures and does not depend on suction. The compressible material and the slip-resistant padding also protect the surfaces of the structure to which the secure dish holder attaches. The method of manufacturing the secure dish holder using a laser cutting system or molding to precisely form holes in the bottom plate provides a simple but effective way to enable the compressible material to wedge the bottom plate into locked and released positions. The secure dish holder may be easily and economically assembled and disassembled for convenient transportation and storage. The secure dish holder is easily attached and removed by an adult but is not easily removed by a child or by wind or movement of the structure to which it is attached. The secure dish holder can be safely manufactured and used and is made of durable materials that maintain proper function over repeated use and cleaning. The method of manufacturing the secure dish holder is effective and relatively simple and inexpensive.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A secure dish holder system for securing an eating dish to prevent said eating dish from spilling comprising:

a support structure having a top surface and a bottom surface;

an eating dish having a topside and underside;

an eating dish fastener attached to said underside of said eating dish;

a dish holder that attaches to said support structure comprising:

a top plate having a topside and an underside, said underside disposed adjacent to said top surface of said support structure;

a top plate fastener attached to said topside of said top plate that engages said eating dish fastener and releasably holds said eating dish firmly to said top side of said top plate to prevent said eating dish from spilling;

at least one post having a predetermined size that is connected to said top plate;

a bottom plate having a topside and an underside, said bottom plate having at least one hole, said at least one hole having a size that is slightly greater than said predetermined size of said at least one said post, said at least one hole in said bottom plate being fitted over said post so that said bottom plate slides snugly along said post, said bottom plate having an inner portion that is located adjacent to said at least one hole and an outer portion that is located along an outer edge of said bottom plate that is on an opposite side of said bottom plate from said inner portion; and a compressible material connected to said outer portion of said topside of said bottom plate that generates a force at a location on said outer portion of said bottom plate when said compressible material is compressed against said bottom surface of said support structure that causes said bottom plate to wedge into a locked position against said at least one post so that application of a release force, that is at least equal to said force generated by said compressible material, to said underside of said bottom plate at said location on said outer portion of said bottom plate causes said bottom plate to move to a position that is substantially normal to said at least one post so that said bottom plate becomes unlocked, and moves in a direction away from said top plate, as said release force is gradually reduced, to release said dish holder from said support structure.

2. The secure dish holder of claim 1 wherein said at least one post comprises two posts that flex independently.

3. The secure dish holder of claim 1 wherein said at least one post, said top plate, and said bottom plate are made of a material selected from the group consisting of metal, metal alloys, plastics, and composites.

4. The secure dish holder of claim 1 wherein said top plate and said bottom plate have a thickness in the range of 0.2 inches to 0.4 inches.

5. The secure dish holder of claim 4 wherein said dimension of said hole of said bottom plate is in the range of 0.005 inches to 0.025 inches greater than said size of said post.

6. The secure dish holder of claim 1 wherein said eating dish fastener and said top plate fastener comprise complementary fasteners of a hook and loop fastener system.

7. The secure dish holder of claim 1 wherein said dimension of said hole in said bottom plate is in the range of 1% to 25% greater than said size of said post.

* * * * *